US009153877B2

(12) United States Patent
Burr

(10) Patent No.: US 9,153,877 B2
(45) Date of Patent: Oct. 6, 2015

(54) HIGH EFFICIENCY MULTI-BEAM ANTENNA

(75) Inventor: Douglas G. Burr, San Jose, CA (US)

(73) Assignee: Space Systems/Loral, LLC, Palo Alto, CA (US)

( * ) Notice: Subject to any disclaimer, the term of this patent is extended or adjusted under 35 U.S.C. 154(b) by 659 days.

(21) Appl. No.: 13/332,145

(22) Filed: Dec. 20, 2011

(65) Prior Publication Data

US 2013/0154874 A1 Jun. 20, 2013

(51) Int. Cl.
*H01Q 1/28* (2006.01)
*H01Q 25/00* (2006.01)

(52) U.S. Cl.
CPC ..... *H01Q 25/007* (2013.01); *H01Q 1/288* (2013.01)

(58) Field of Classification Search
CPC ..... H01Q 25/007; H01Q 1/288; H01Q 21/00–21/30; H01Q 1/28
USPC ..... 343/776–779
See application file for complete search history.

(56) References Cited

U.S. PATENT DOCUMENTS

| | | | | |
|---|---|---|---|---|
| 5,113,197 | A * | 5/1992 | Luh | 343/776 |
| 6,219,003 | B1 * | 4/2001 | Chandler | 343/779 |
| 6,272,340 | B1 * | 8/2001 | Wright et al. | 455/427 |
| 7,161,549 | B1 * | 1/2007 | Cuchanski et al. | 343/781 CA |
| 7,522,116 | B2 | 4/2009 | Balling et al. | |
| 8,315,557 | B1 * | 11/2012 | Rao et al. | 455/13.3 |
| 2003/0025644 | A1 * | 2/2003 | Judasz | 343/840 |
| 2004/0189538 | A1 * | 9/2004 | Rao et al. | 343/757 |
| 2008/0291083 | A1 * | 11/2008 | Chang | 342/354 |
| 2010/0117893 | A1 * | 5/2010 | Dreher et al. | 342/352 |
| 2010/0309050 | A1 * | 12/2010 | Raguenet | 342/368 |
| 2011/0032173 | A1 * | 2/2011 | Chang et al. | 343/880 |
| 2011/0267251 | A1 * | 11/2011 | Mathews et al. | 343/779 |

FOREIGN PATENT DOCUMENTS

| | | |
|---|---|---|
| EP | 2120281 | 11/2009 |
| GB | 2262387 | 6/1993 |
| GB | 2479999 | 11/2011 |

OTHER PUBLICATIONS

Kenji Ueno, "Properties of a Large Scale Multibeam Antenna Using a Phased Array Fed Reflector with Radially Aligned Elements", 1999, Antennas and Propagation Society International Symposium, 1999. IEEE (vol. 4 ), pp. 2298-2301.*

Nelson, Robert a. "Antennas: the Interface with Space"[online] [retrieved May 28, 2011] Retrieved from hap .ThATIN-w aticources cornlantennas tutorial htm, 9 pp.

Cottatellucci, L, et al. (Jun. 2006) "Interference Mitigation Techniques for Broadband Satellite Systems", whitepaper, 24th Aiaa International Communications Satellite Systems Conference, Jun. 11-15, 2006, San Diego, Ca, 13 pp.

(Continued)

*Primary Examiner* — Gennadiy Tsvey
(74) *Attorney, Agent, or Firm* — Weaver Austin Villeneuve & Sampson LLP

(57) ABSTRACT

A spacecraft has a high efficiency multi-beam antenna (MBA) system that serves a coverage region on the Earth. The coverage region subtends an angle, when viewed from the spacecraft, of at least ten degrees. The antenna system provides, within the coverage region, at least sixteen spot beams. A signal provided by the MBA system to each spot beam has a carrier to interference ratio (C/I) of no less than 20 dB. The system enables use of a three color frequency reuse scheme without recourse to signal encoding.

28 Claims, 7 Drawing Sheets

(56) References Cited

OTHER PUBLICATIONS

Gehring, Ralf, et al. (Apr. 2007) "Trade-Off for Overlapping Feed Array Configurations", 29th Esa Antenna Workshop on Multiple Beams and Reconfigurable Antennas, Estec, Noordwijk, the Netherlands, 4 pp.

Ahmad, Ghulam et al., "Modern Communication Satellite Antenna Technology", University of Engineering & Technology Lahore, Pakistan, Recent Advances in Technologies, Isbn 978-953-307-017-9, Nov. 2009, pp. 301-326.

Han, C.C., et al., "Satellite Antennas", Antenna Handbook, vol. 3, chapter 21, edited by Lo, Y.T., et al., ISBN 0-442-01594-1, 1993.

International Search Report and Written Opinion dated Mar. 20, 2013 issued in PCT/US2012/068166.

* cited by examiner

FIG. 1 –PRIOR ART

HIGH EFFICIENCY MULTI-BEAM ANTENNA

TECHNICAL FIELD

This invention relates generally to satellite antennas, and particularly to a high efficiency multi-beam antenna for a geosynchronous wide-band communications satellite.

BACKGROUND

The assignee of the present invention manufactures and deploys spacecraft for, inter alia, communications and broadcast services from geosynchronous orbit. Market demands for such spacecraft have imposed increasingly stringent requirements on spacecraft payloads. For example, broadband service providers desire spacecraft with payloads offering increased data rate capacity at higher effective isotropic radiated power (EIRP) through each of an increased number of user spot beans.

A multi-beam antenna (MBA) system generates a set of user spot beams that define a coverage area which may extend, in aggregate, across a large region on the ground. MBA's providing wide-band communications services from a geosynchronous satellite conventionally provide contiguous coverage of a region with a triangular lattice of overlapping circular antenna beams. These beams are conventionally formed using close packed clusters of circular feed horns, also centered on a triangular lattice. The feed horns illuminate, for example, offset fed parabolic reflectors to provide the desired antenna gain. Since, in order to provide contiguous coverage, the circular beams must overlap, the unique coverage area of each individual beam is normally defined as the inscribed hexagon of the edge of coverage circular gain contour, as illustrated in FIG. 1. The corners of the hexagon are located at the points where the edge of coverage gain contours from three adjacent beams cross. The sides of the hexagons represent points of approximately equal performance between adjacent beams.

An objective of many MBA systems is to enhance spectrum utilization efficiency by providing for frequency reuse among the multiple antenna beams. To avoid interference near the beam edges, known payload designs provide that unencoded signals in adjacent, and nearly adjacent, beams utilize distinctly different combinations of frequency sub band and polarization. For example, a "four-color" frequency reuse scheme, also illustrated in FIG. 1, is known, where each color of the four color scheme defines a particular combination of frequency sub band and polarization. Features of such a coverage pattern are discussed in Gehring, et al., "Trade-off for Overlapping Feed Array Configurations, $29^{th}$ ESA Antenna Workshop on Multiple Beams and Reconfigurable Antennas", April 2007 (hereinafter "Gehring"), the disclosure of which is hereby incorporated by reference. Interference mitigation may also be achieved by various encoding schemes, as disclosed by Cottatellucci, et al., "Interference mitigation techniques for broadband satellite system", ICSSC 2006, 24th AIAA International Communications Satellite Systems Conference, 11-15 Jun. 2006, San Diego, USA (hereinafter, "Cottatellucci"), the disclosure of which is hereby incorporated by reference.

Another objective of an MBA system is to maximize beam forming efficiency, measured as gain area product (GAP) of the MBA divided by 4π steradians (41,253 square degrees). $GAP=G_{min}*A_{cov}$, where $G_{min}$ is the gain over coverage area, $A_{cov}$, with $A_{cov}$ expressed in square degrees. Known MBA systems provide a GAP of 10000-16000 and, therefore, a beam forming efficiency in the range of 24% to 39%, although higher efficiencies are desirable See: Han, C. C., et al., "Satellite Antennas", *Antenna Handbook*, volume 3, chapter 21, edited by Lo, Y. T., et al., ISBN 0-442-01594-1 (hereinafter, "Han"), the disclosure of which is hereby incorporated by reference.

As the above mentioned references, at least, make clear, there is a long-felt need for a high throughput spacecraft that more efficiently uses available frequency spectrum and improves beam forming efficiency of a multi beam antenna.

SUMMARY

The present inventor has appreciated that a substantial improvement in broadband service capacity may be achieved by an MBA system providing, within a coverage region, a number of spot beams, using a three color, unencoded, frequency reuse scheme, where the carrier to interference ratio (C/I) associated with interference between any two spot beams having a common polarization and frequency sub band, is no less than 20 dB In some embodiments, a greater than 33% increase in satellite capacity may be realized in comparison to conventional methods, as well as substantial improvements in antenna efficiency and gain-area product. In an embodiment, an antenna reflector is substantially oversized with respect to a conventional design criterion of sizing the reflector to produce a circular beam that is 4-4.5 dB down at the edge of coverage.

In an embodiment, a spacecraft having a multi-beam antenna (MBA) system is configured to provide a communications service to a coverage region on the Earth. The coverage region subtending an angle, when viewed from the spacecraft, of at least ten degrees, and the MBA system is configured to provide, within the coverage region, at least sixteen spot beams. The communication service to the coverage region employs a three color frequency reuse scheme, where each color of the three color frequency reuse scheme defines a different particular combination of frequency sub band and polarization. a carrier to interference ratio (C/I) associated with interference between any two commonly colored spot beams is at least 20 dB.

In an embodiment, the spacecraft may be configured to operate in a geosynchronous orbit. The coverage region may subtend an angle with respect to the MBA system of twenty degrees, and the antenna system may provide, within the coverage region, at least sixty spot beams.

In another embodiment, the MBA system may include a number of reflectors, each reflector illuminated by a respective plurality of feed elements. In one embodiment, the MBA system consists of three reflectors, and the MBA system is configured to interleave beams from each of the three reflectors to form a contiguous triangular lattice of spot beams within the coverage region. Each respective plurality of feed elements may be configured to provide an output in accordance with a respective color of the three color frequency reuse scheme.

In an embodiment, the MBA system may operate at Ka band and include three reflectors, each reflector being at least one meter in diameter.

In an embodiment, the MBA may have a focal length to diameter ratio (F/D) of less than 1.5. In another embodiment, the F/D may be approximately one.

In another embodiment, each reflector is approximately 1.2 meter in diameter.

In a further embodiment, second order sidelobes of each of the respective plurality of feed elements illuminate the reflector. The feed array may be sized and located such that a main lobe of the feed array falls only on a central portion of a reflector surface. The central portion of the reflector may not exceed the center ⅓ of the reflector surface.

In another embodiment, the communication service may be provided by way of unencoded signals. The C/I associated with interference between any two commonly colored spot beams may be at least 23 dB.

In an embodiment, a multi-beam antenna (MBA) system for a spacecraft is configured to provide a communications service to a coverage region on the Earth, the coverage region subtending an angle, when viewed from the spacecraft, of at least ten degrees. The MBA system is configured to provide, within the coverage region, at least sixteen spot beams, the communication service to the coverage region employs a three color frequency reuse scheme, wherein each color of the three color frequency reuse scheme defines a different particular combination of frequency sub band and polarization, and a carrier to interference ratio (C/I) associated with interference between any two commonly colored spot beams is at least 20 dB.

In an embodiment, a spacecraft having a multi-beam antenna (MBA) system is configured to provide a communications service to a coverage region on the Earth, the coverage region subtending an angle, when viewed from the spacecraft, of approximately five degrees. The MBA system is configured to provide, within the coverage region, at least sixteen spot beams. The communication service to the coverage region employs a three color frequency reuse scheme, wherein each color of the three color frequency reuse scheme defines a different particular combination of frequency sub band and polarization. A carrier to interference ratio (C/I) associated with interference between any two commonly colored spot beams is at least 20 dB.

In a further embodiment, the spacecraft may be configured to operate in a geosynchronous orbit. The MBA system may operate at Ka band and include three reflectors, each reflector being at least one meter in diameter. Each reflector may be illuminated by a respective plurality of feed elements, and each respective plurality of feed elements may be configured to provide an output in accordance with a respective color of the three color frequency reuse scheme.

In an embodiment, each reflector may be approximately 1.2 meter in diameter. The communication service may be provided by way of unencoded signals.

In yet a further embodiment, a spacecraft having a multi-beam antenna (MBA) system is configured to provide a communications service to a coverage region on the Earth, the coverage region subtending an angle, when viewed from the spacecraft, of approximately five degrees. The MBA system is configured to provide, within the coverage region, at least sixteen spot beams. The communication service to the coverage region employs a three color frequency reuse scheme. Each color of the three color frequency reuse scheme defines a different particular combination of frequency sub band and polarization, and a carrier to interference ratio (C/I) associated with interference between any two commonly colored spot beams is at least 20 dB.

BRIEF DESCRIPTION OF THE DRAWINGS

Features of the invention are more fully disclosed in the following detailed description of the preferred embodiments, reference being had to the accompanying drawings, in which.

Figure 1:
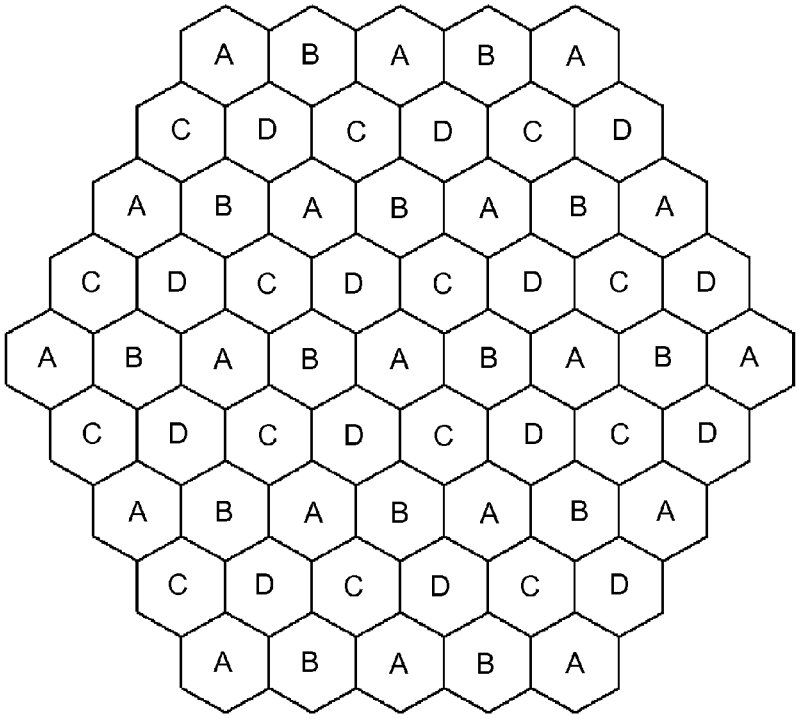
FIG. 1 illustrates a coverage pattern employing a four color frequency reuse pattern of the prior art.

Throughout the drawings, the same reference numerals and characters, unless otherwise stated, are used to denote like features, elements, components, or portions of the illustrated embodiments. Moreover, while the subject invention will now be described in detail with reference to the drawings, the description is done in connection with the illustrative embodiments. It is intended that changes and modifications can be made to the described embodiments without departing from the true scope and spirit of the subject invention as defined by the appended claims.

DETAILED DESCRIPTION

Specific exemplary embodiments of the invention will now be described with reference to the accompanying drawings. This invention may, however, be embodied in many different forms, and should not be construed as limited to the embodiments set forth herein. Rather, these embodiments are provided so that this disclosure will be thorough and complete, and will fully convey the scope of the invention to those skilled in the art.

It will be understood that when an element is referred to as being "connected" or "coupled" to another element, it can be directly connected or coupled to the other element, or intervening elements may be present. Furthermore, "connected" or "coupled" as used herein may include wirelessly connected or coupled. It will be understood that although the terms "first" and "second" are used herein to describe various elements, these elements should not be limited by these terms. These terms are used only to distinguish one element from another element. Thus, for example, a first user terminal could be termed a second user terminal, and similarly, a second user terminal may be termed a first user terminal without departing from the teachings of the present invention. As used herein, the term "and/or" includes any and all combinations of one or more of the associated listed items. The symbol "/" is also used as a shorthand notation for "and/or".

The terms "spacecraft", "satellite" and "vehicle" may be used interchangeably herein, and generally refer to any orbiting satellite or spacecraft system.

Embodiments disclosed hereinbelow achieve a substantial improvement in spectrum utilization for an MBA system. In an embodiment, The MBA system may provide, within a coverage region, a large number of uniformly sized high gain spot beams. The spot beams may be centered on a triangular lattice such that each spot beam is equidistant from its six closest neighbors. A coverage polygon for each individual spot beam may be defined as a hexagon where the sides of the hexagon are at points of equal performance of adjacent beams. Advantageously, a three color frequency reuse scheme may be employed, where the carrier to interference ratio (C/I) associated with interference between any two spot beams having a common polarization and frequency sub band, is at least 20 dB. In an embodiment, the C/I may be at least 25 dB. Advantageously, an increase in satellite capacity of at least 33% may be realized with respect to conventional schemes employing a four color frequency reuse scheme.

The present inventor has realized substantial improvements in antenna efficiency and gain-area product with respect to conventional techniques. In an embodiment, the above mentioned improvements are obtained as a result of "oversizing" the MBA optics, which means, for example, that the antenna reflectors and feed elements may each be substantially oversized with respect to conventional design criteria. For example, known MBA designs size each reflector to produce a circular beam that is 4-4.5 dB down at edge of coverage, whereas the feed element is typically a horn large enough to produce an aperture edge illumination of the reflector that is 12 to 15 dB below the peak of the feed pattern. This edge illumination can only be achieved with feed diameters that are as much as two times the required feed spacing in the reflector focal plane for two adjacent beams. A tightly packed row of such feeds in the focal plane will produce a row of beams on the ground with a space between each beam where an adjacent beam should be. These beams are interleaved with beams from a second reflector to produce a continuous row of beams. Two additional reflectors are used to produce the beams for the adjacent rows. This is a four aperture MBA.

Figure 6:
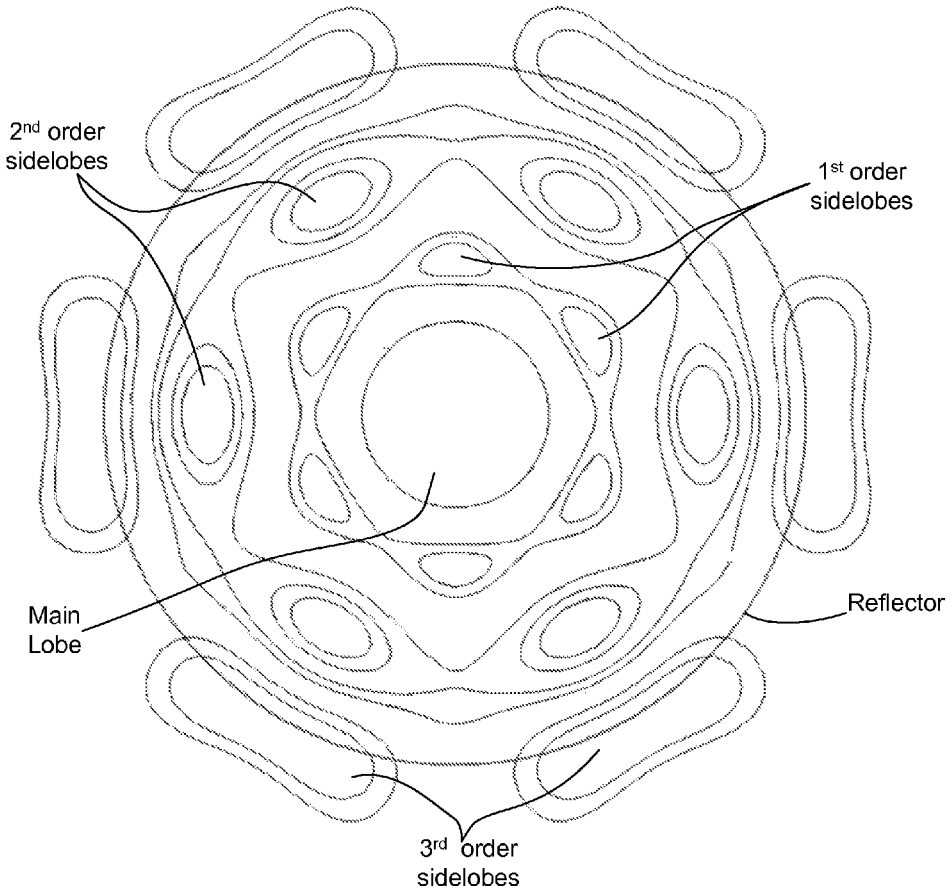
FIG. 6 illustrates a contour plot of illumination of a feed on a reflector.

The present inventor has found that a high efficiency design may be achieved by increasing the reflector diameter by a factor of two or more while avoiding an increase in the focal length. As a result, the subtended angle of the reflector as seen by the feed may be increased by a factor of two or more and, as illustrated in FIG. 6, a −15 dB contour of the feed (that would appear at the edge of the conventional design reflector) may be located at less than half of the radius of the oversized reflector. Advantageously, as also illustrated in FIG. 6, first order sidelobes of the feed fall completely on the reflector and contribute to beam shaping in the form of rapid roll off outside of the beam polygon and flat topping inside the polygon. As a result spill-over loss associated with the conventional design, (attributable to power in the sidelobes that conventionally does not illuminate the reflector) is avoided.

Figure 3:
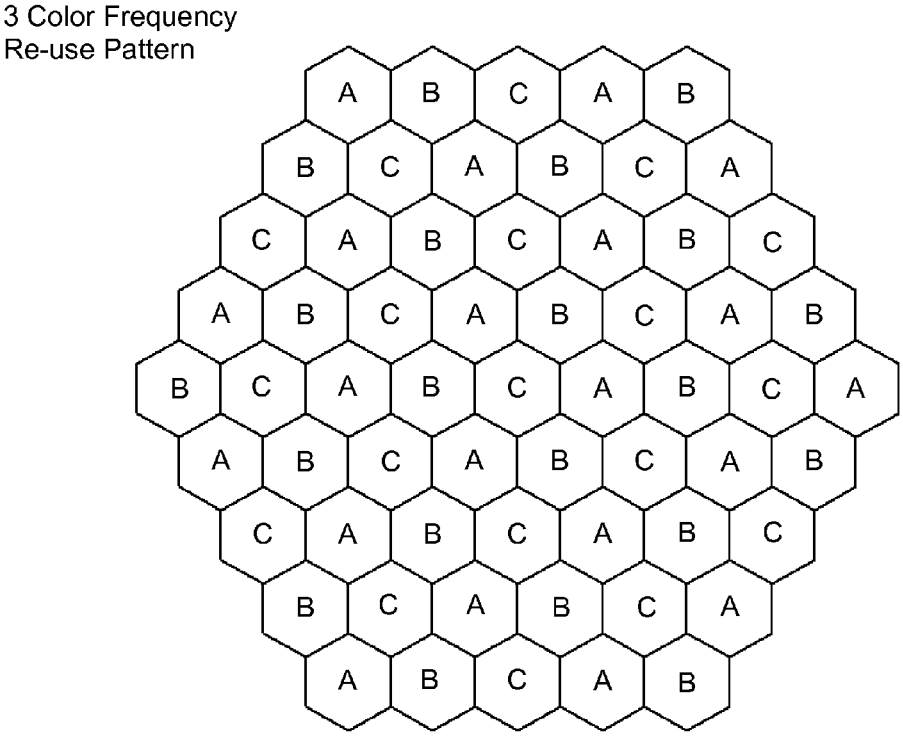
FIG. 3 illustrates a three color frequency reuse pattern in accordance with an embodiment.

Advantageously, the present MBA may have as few as three apertures to provide a contiguous triangular lattice of spot beams. Parabolic reflectors produce beams whose angular location is determined by the location of the feed in the focal plane and the distance from the feed to the center of the reflector. The relationship is that the scan angle of the beam is approximately the arcsine of the feed distance from the focal point divided by the distance from the feed to the center of the reflector. The scan angle divided by the distance from the focal point to the feed is the beam deviation factor (BDF) and is used to locate the individual feeds in the focal plane to produce the desired beam locations. The width of the feed may be approximated by dividing the desired beamwidth by the BDF. The optimum feed width will be larger than the resulting number such that there will be overlapping coverage at adjacent beam boundaries. The present inventor has appreciated that, since the feed width will be only slightly larger than the adjacent beam spacing in the focal plane, a contiguous lattice of spot beams, as illustrated in FIG. 3, may be achieved with as few as three apertures. Moreover, the apertures may be simple offset fed parabolic reflectors for which no special surface shaping is required.

In an embodiment, the MBA may be configured to provide a coverage region subtending an angle with respect to the MBA of at least 10 degrees. Each spot beam within the coverage region may subtend an angle of about 2 degrees, and, for example, sixteen spot beams may be provided.

Figure 2:
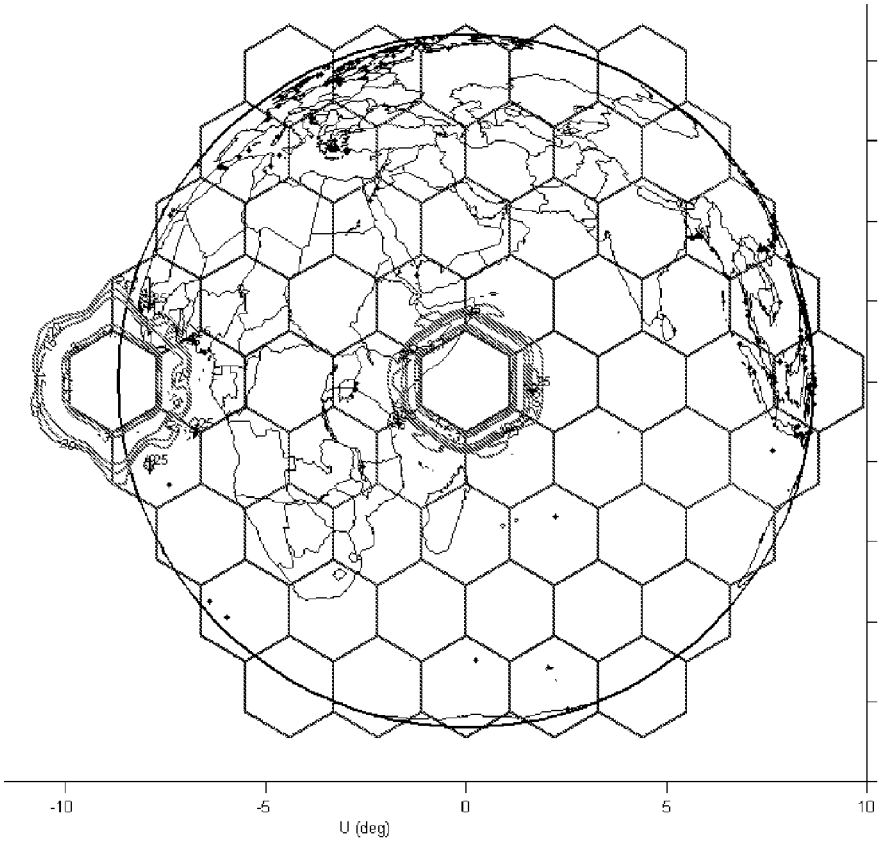
FIG. 2 illustrates a coverage pattern in accordance with an embodiment.

In a further embodiment, the MBA may be configured to provide a coverage region subtending an angle with respect to the MBA of about 18 degrees, which is approximately the angle subtended by the Earth when viewed from geosynchronous orbit. Referring now to FIG. 2, in an embodiment, a coverage region encompassing the entire visible earth surface may be provided by sixty one spot beams spaced at about 2.2 degree intervals.

Figure 4:
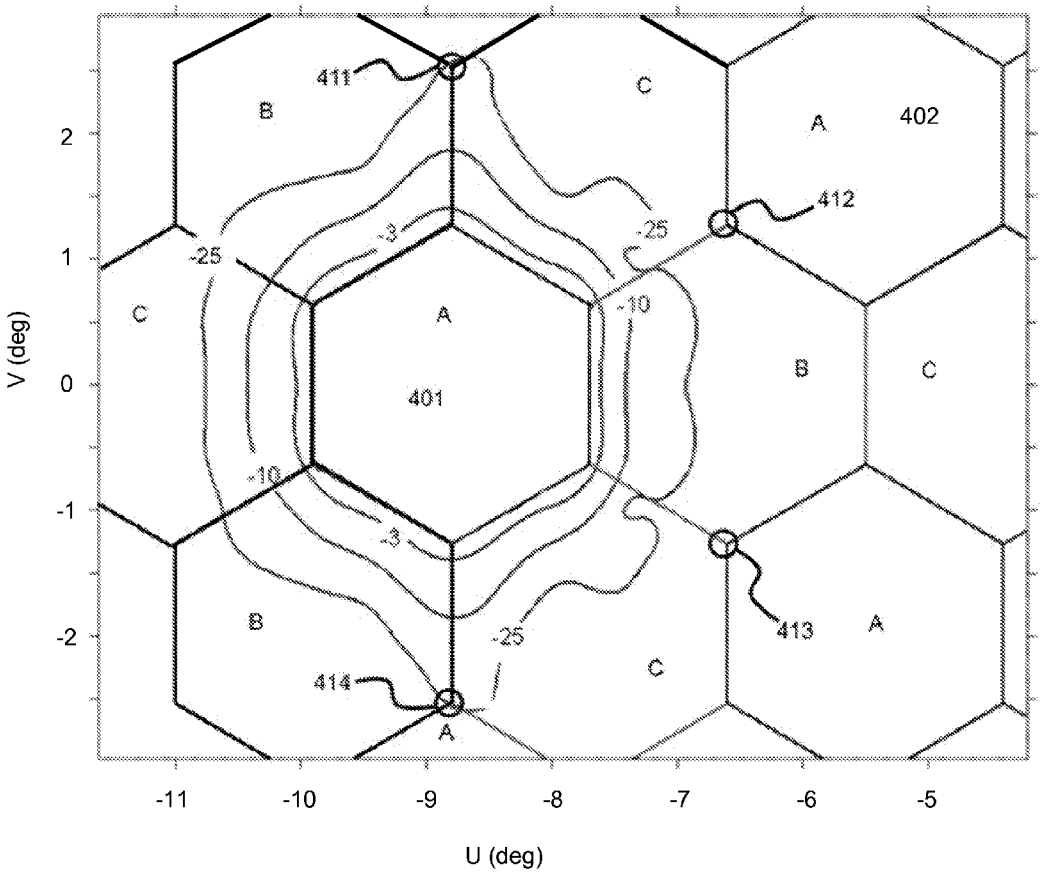
FIG. 4 illustrates a contour plot of MBA directivity with respect to peak directivity in accordance with an embodiment.

The present inventor has found that oversizing the MBA optics advantageously reduces interference between nearly adjacent beams having a common frequency sub band and polarization. As a result, "commonly colored" spot beams (i.e., spot beams having a common frequency sub band and polarization) may be more closely spaced, such that, instead of a conventional "four color" pattern (FIG. 1), a three color reuse pattern, illustrated in FIG. 3, may, advantageously, be employed. In an embodiment, carrier to interference ratio (C/I) associated with interference between any two spot beams of a given color in the three color reuse pattern may be at least 20 dB. Advantageously, as illustrated in FIG. 4, the C/I may be at least 25 dB.

In an embodiment, a C/I of 20 dB or higher is achieved by improving edge of coverage characteristics of each spot beam, and maximizing efficiency in the form of gain area product within the coverage area polygon of each spot beam. This is accomplished by minimizing spill-over loss, scan loss and the amount of energy outside of the coverage region. To accomplish this, in an embodiment, an antenna system producing a flat-top beam within the coverage region of each spot beam, with a steep roll-off outside the coverage region, is provided.

In an embodiment, a reflector system with an aperture substantially larger than the minimum aperture size required to produce a circular beam that is 4-4.5 dB down at the corners of each hexagonal coverage region may be provided. Advantageously, the oversized reflector may be combined with oversized feed elements. In an embodiment, each oversized feed element may be sized large enough such that as illustrated in FIG. 6, the main lobe and at least the first order sidelobes of the feed illuminate the reflector, resulting in minimal spill-over loss. Advantageously, second order or even higher order sidelobes may illuminate the reflector. With this configuration, far field contours of the antenna beam may resemble an image of the electric field distribution over the feed aperture.

In order to produce the flat top beam over the coverage region, in an embodiment, a feed element may be selected that can produce an aperture distribution that is substantially uniform in amplitude and phase, such as a phased array. For example, uniform aperture distribution may result from a boresight beam illuminating an oversized reflector. Starting with the uniform distribution, amplitude and phase distribution may be optimized over a number of feed elements illuminating the reflector. In order to provide the steep roll-off outside the coverage region, in an embodiment, the feed element aperture may be in the shape of a hexagon.

Referring again to FIG. 4, contour plots of MBA directivity with respect to peak directivity for a typical spot beam coverage area 401 are illustrated. It may be observed that, because of the above-mentioned steep roll-off, nearly adjacent coverage areas such as 401 and 402 may each be configured at an identical combination of frequency sub-band and polarization, with negligible mutual interference. For example, at the point of closest approach between coverage areas 401 and 402, (i.e., location 412) the signal strength of the beam assigned to coverage area 401 is down more than 25 dB from peak. Similarly, at locations, 411, 413, and 414, the signal strength of the beam assigned to coverage area 401 is down at least 25 dB from peak. As a result, a three color frequency reuse scheme may, be employed with negligible mutual interference between nearly adjacent coverage areas of the same color. Advantageously, the three color frequency reuse scheme may be employed while avoiding use of a signal encoding scheme.

Figure 5:
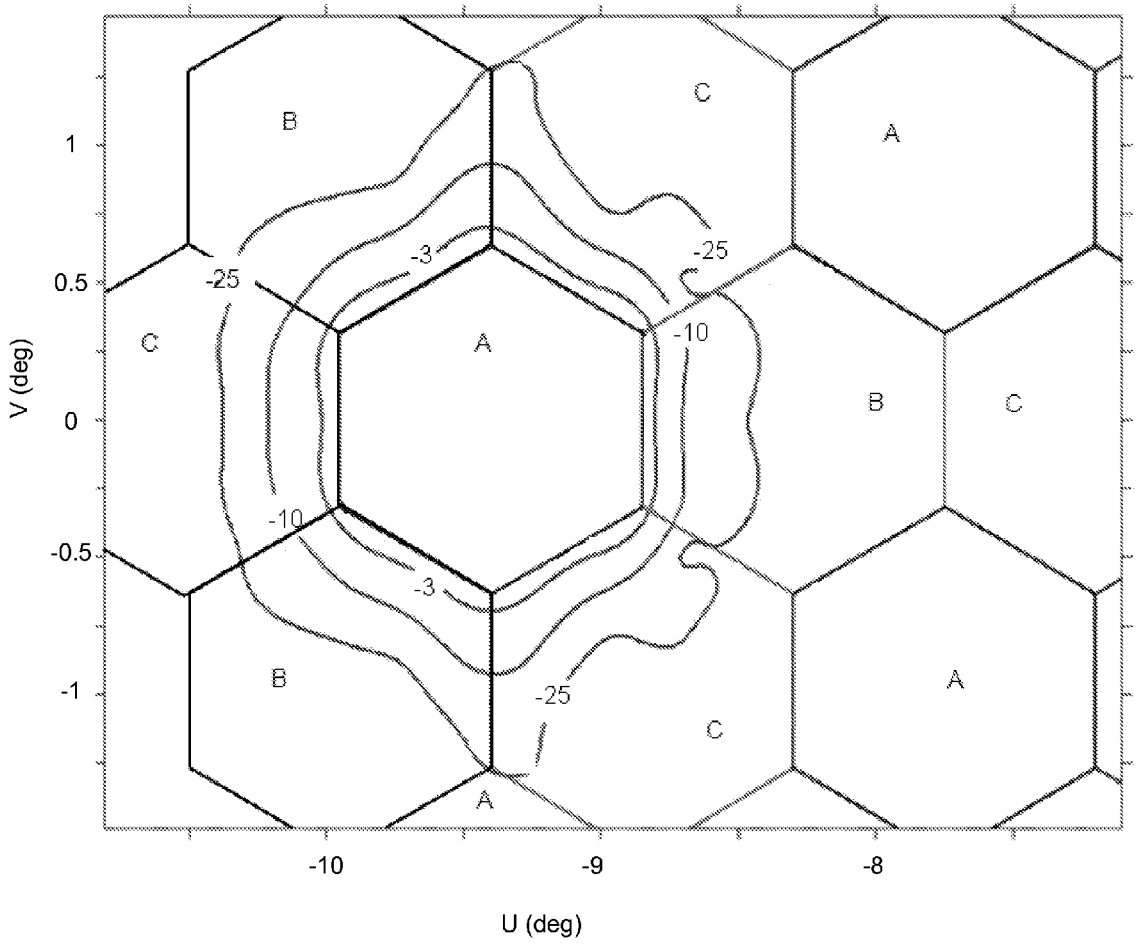
FIG. 5 illustrates a contour plot of MBA directivity with respect to peak directivity in accordance with a further embodiment.

The present teachings may be directed toward an antenna design configured to produce small beams with high directivity for such applications as regional coverage of a single country or group of countries. For example, referring now to FIG. 5, an antenna system including three 2.9 meter reflectors may provide a lattice of beams with 0.9 degree spacing. The present inventor has found that such an antenna system may provide the same gain area product and C/I performance as the system described above, but with approximately 7.8 dB higher minimum edge of coverage directivity.

In an embodiment, the MBA system may be configured to provide a contiguous lattice of hexagonal coverage areas. The beams from each aperture may be interleaved in the far field such that adjacent feeds in a single feed cluster are spaced far enough apart that they do not have to produce adjacent beams in the contiguous lattice. This allows the feeds to be large enough to more efficiently illuminate the reflector, thus reducing spill-over losses. For example, three reflectors may be used. The present inventor has found that, because the MBA optics are "oversized" with respect to conventional designs, as few as three apertures are sufficient to accommodate the oversized hexagonal feeds with virtually no spill-over loss. For example, for an MBA system operating at Ka band, having three reflectors providing full earth coverage from geosynchronous orbit, each reflector may have an aperture diameter of at least one meter. In an embodiment, each of the three apertures may be dedicated to a single, respective "color".

A further advantage of the present teachings is that the MBA may be configured with a smaller than conventional focal length to diameter ratio (F/D).

Figure 7:
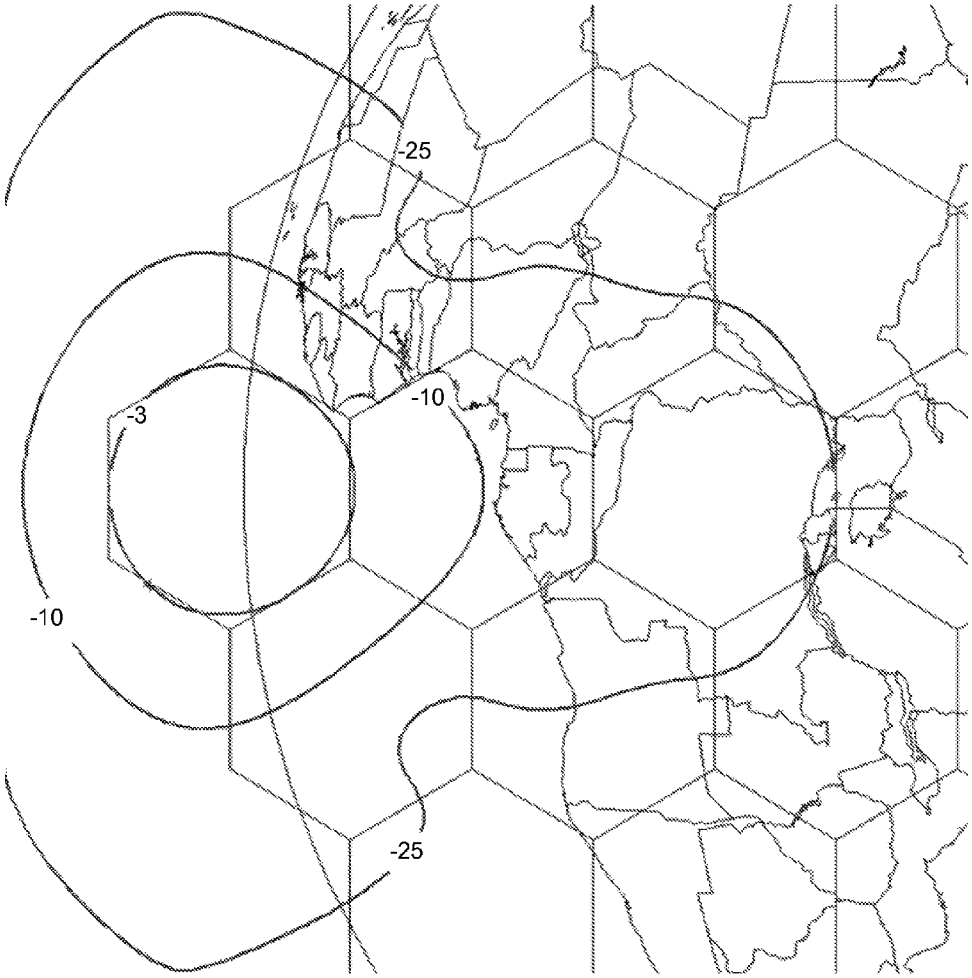
FIG. 7 illustrates a contour plot for a conventional MBA.

A conventional MBA with a single feed horn per beam uses relatively large F/D Values to mitigate scan loss and scan distortion associated with a single offset reflector geometry. Otherwise, a feed that is some distance in the focal plane from the focal point will produce a scanned beam that is excessively displaced from the boresight direction. Moreover, the feed-reflector geometry for the scanned beam will produce phase errors across the reflector surface that will distort the beam contours and produce loss and copolarized interference between beams of the same color. The resulting reduction in carrier to interference ratio (C/I) limits the capacity of the system. As illustrated in FIG. 7, C/I values in the conventional MBA with an F/D>1.7 may vary from about 7 dB to about 20 dB depending on the number of colors in the frequency reuse plan and the scan angle and direction.

In accordance with the present teachings, in an embodiment, the sidelobes of the individual feed elements illuminate the reflector and provide beam shaping, to produce a near flat top beam within a coverage polygon, while avoiding a requirement to specially shape the reflector surface. Advantageously, the feed array may be sized and located so as to under illuminate the reflector such that the main lobe of the feed array falls only on the central portion of the reflector, typically the center ⅓ or less of the reflector, as shown in FIG. 6. The present inventor has found that a smaller than conventional F/D, typically about one, may be utilized by optimizing phase and amplitude coefficients to correct the scan distortion for the individual feed arrays.

A still further advantage of the present teachings is that the gain-area product (GAP) of the MBA may be substantially improved with respect to conventional techniques. As is known in the art, GAP is a measure of how efficiently an antenna radiates power into a coverage area. The coverage area may be described in units of solid angle such as steradians (sr), if the unit of angle is the radian, or square degrees if the unit of angle is the degree. GAP is defined as the gain of the antenna integrated over the solid angle of the coverage area. A perfect omni-directional antenna is defined as one that radiates equally in all directions with a gain of 1 and 100% efficiency. The GAP for such an antenna is $1\times4\pi$ sr or 41,253 square degrees. Correspondingly, the beam-shaping efficiency of a directional antenna has been defined as the actual GAP of the antenna in square degrees divided by 41,253. This efficiency represents the fraction of total radiated power that is illuminating the coverage area. The GA product for a conventional satellite MBA is between about 10,000 and 16,000 for a beam forming efficiency of about 24%-39%. Han, p. 7. The present inventor has found that an MBA designed in accordance with the present teachings may achieve a GAP of 25,000 or higher. In an embodiment, to which the contour plot of FIG. 4 relates, a GAP of 29,400 or an efficiency of 71% has been achieved.

Thus, a high efficiency multi-beam antenna system has been disclosed. The foregoing merely illustrates principles of the invention. It will thus be appreciated that those skilled in the art will be able to devise numerous systems and methods which, although not explicitly shown or described herein, embody said principles of the invention and are thus within the spirit and scope of the invention as defined by the following claims.

What is claimed is:

1. A spacecraft having a multi-beam antenna (MBA) system configured to provide a communications service to a coverage region on the Earth, the MBA system comprising at least one reflector having a substantially parabolic surface; and a plurality of feed elements disposed in a focal plane of the at least one reflector and configured as a phased array that illuminates the reflector, wherein:

first order sidelobes of the plurality of feed elements fall completely on the reflector and second order sidelobes of at least some of the respective plurality of feed elements illuminate the reflector; and the first order sidelobes and the second order sidelobes provide beam shaping, in the absence of additional shaping of the substantially parabolic surface, characteristics of the beam shaping including a signal strength within a polygonal coverage region that is no more than 4 dB down from a maximum within the polygonal coverage region and, outside of the polygonal coverage region, rolls off rapidly, wherein at least one of the feed elements includes an aperture having a hexagonal shape.

2. The spacecraft of claim 1, wherein the at least one reflector consists of three reflectors, and the MBA system is configured to interleave beams from each of the three reflectors to form a contiguous triangular lattice of spot beams within the polygonal coverage region.

3. The spacecraft of claim 2, wherein each respective plurality of feed elements is configured to provide an output in accordance with a respective color of the three color frequency reuse scheme.

4. The spacecraft of claim 2 wherein the MBA system operates at Ka band and each reflector is at least one meter in diameter.

5. The spacecraft of claim 4, wherein each reflector has a focal length to diameter ratio (F/D) of less than 1.5.

6. The spacecraft of claim 5, wherein the F/D is approximately one.

7. The spacecraft of claim 2, wherein, for each reflector, second order sidelobes of each of the respective plurality of feed elements illuminate the reflector.

8. The spacecraft of claim 7, wherein the respective plurality of feed elements are sized and located such that a main lobe of each feed element illuminates only a central portion of a reflector surface.

9. The spacecraft of claim 8, wherein the diameter of the central portion of the reflector does not exceed one half of the diameter of the reflector surface.

10. The spacecraft of claim 1, wherein the communication service is provided by way of unencoded signals.

11. The spacecraft of claim 3, wherein the carrier to interference ratio associated with interference between any two commonly colored spot beams is at least 23 dB.

12. An apparatus comprising:

a multi-beam antenna (MBA) system for a spacecraft, the MBA system including at least three reflectors, each reflector having a substantially parabolic surface and being illuminated by a respective plurality of feed elements disposed in a focal plane of each reflector and configured as phased array, wherein:

first order sidelobes of the plurality of feed elements fall completely on the reflector and second order sidelobes of at least some of the respective plurality of feed elements illuminate the reflector;

the first order sidelobes and the second order sidelobes provide beam shaping, in the absence of additional shaping of the substantially parabolic surface, characteristics of the beam shaping including a signal strength within a polygonal coverage region that is no more than 4 dB down from a maximum within the polygonal coverage region and, outside of the polygonal coverage region, rolls off rapidly;

a first reflector of the at least three reflectors produces a first plurality of beams in a row with a space between each beam;

a second reflector of the at least three reflectors produces a second plurality of beams in the row; and a third reflector of the at least three reflectors produces a third plurality of beams in the row such that the first plurality of beams, the second plurality of beams, and the third plurality of beams produce a substantially continuous row of beams, wherein at least one of the feed elements includes an aperture having a hexagonal shape.

13. The apparatus of claim 12, wherein the MBA system is configured to provide a communications service to a coverage region on the Earth, the coverage region subtending an angel, when viewed from the spacecraft in a geosynchronous orbit, of at least ten degrees;

the communication service to the coverage region provides at least sixteen spot beams and employs a three color frequency reuse scheme, each color of the three color frequency reuse scheme defining a different particular combination of frequency sub band polarization; and a carrier to interference ratio (C/I) associated with interference between any two commonly colored spot beams is at least 20 db.

14. The apparatus of claim 12, wherein the MBA system operates at Ka band and comprises three reflectors, each reflector being at least one meter in diameter.

15. The apparatus of claim 13, wherein each reflector is illuminated by a respective plurality of feed elements, and each feed element of the respective plurality of feed elements is configured to provide an output in accordance with a respective color of the three color frequency reuse scheme.

16. The apparatus of claim 15, wherein each reflector is approximately 1.2 meter in diameter.

17. The apparatus of claim 16, wherein second order sidelobes of the feed array illuminate the reflector.

18. The apparatus of claim 16, wherein the feed array is sized and located such that a main lobe of the feed array falls only on a central portion of the reflector.

19. The apparatus of claim 18, wherein the diameter of the central portion of the reflector does not exceed one half of the diameter of the reflector surface.

20. The apparatus of claim 12, wherein communication service is provided by way of unencoded signals.

21. The apparatus of claim 12, wherein the C/I associated with interference between any two commonly colored spot beams is at least 23 dB.

22. A spacecraft having a multi-beam antenna (MBA) system including at least two reflectors, each reflector having a substantially parabolic surface and being illuminated by a respective phased array, each respective phased array including a plurality of feed elements disposed in a focal plane of each reflector wherein:

first order sidelobes of the plurality of feed elements fall completely on the reflector and second order sidelobes of each of the respective plurality of feed elements illuminate the reflector and the first order sidelobes and the second order sidelobes provide beam shaping, in the absence of additional shaping of the substantially parabolic surface, characteristics of the beam shaping including a signal strength within polygonal coverage region that is no more than 4 dB down from a maximum within the polygonal coverage region and, outside of the polygonal coverage region, rolls off rapidly;

the respective plurality of feed elements are sized and located such that a main lobe of each feed element illuminates only a central portion of a reflector surface, the central portion having a diameter no greater than one half of the diameter of the reflector surface, wherein at least one of the feed elements includes an aperture having a hexagonal shape.

23. The spacecraft of claim 22, wherein the spacecraft is configured to operate in a geosynchronous orbit.

24. The spacecraft of claim 23, wherein the MBA system operates at Ka band and comprises three reflectors, each reflector being at least one meter in diameter.

25. The spacecraft of claim 24, wherein each reflector is illuminated by a respective feed array, and each respective feed array is configured to provide an output in accordance with a respective color of a three color frequency reuse scheme, each color of the three color frequency reuse scheme defining a different particular combination of frequency sub band and polarization.

26. The spacecraft of claim 25, wherein each reflector is approximately 1.9 meter in diameter.

27. The spacecraft of claim 22, wherein the communication service is provided by way of unencoded signals.

28. The spacecraft of claim 25, wherein the carrier to interference ratio associated with interference between any two commonly colored spot beams is at least 23 dB.

* * * * *

UNITED STATES PATENT AND TRADEMARK OFFICE

CERTIFICATE OF CORRECTION

PATENT NO. : 9,153,877 B2
APPLICATION NO. : 13/332145
DATED : October 6, 2015
INVENTOR(S) : Douglas G. Burr It is certified that error appears in the above-identified patent and that said Letters Patent is hereby corrected as shown below:

In the Claims

1. In claim 3, Column 8, lines 61-62, change "the three color frequency" to --a three color frequency--.

2. In claim 13, Column 9, line 52, change "subtending an angel" to --subtending an angle--.

3. In claim 13, Column 9, line 59, change "sub band polarization" to --sub band and polarization--.

Signed and Sealed this
Twelfth Day of July, 2016

Michelle K. Lee

Michelle K. Lee
*Director of the United States Patent and Trademark Office*